US011832374B1

(12) United States Patent
Ripley et al.

(10) Patent No.: US 11,832,374 B1
(45) Date of Patent: Nov. 28, 2023

(54) METHOD OF MAKING AN ANNULAR RADIOISOTOPE TARGET HAVING A HELICAL COIL-SHAPED FOIL RIBBON BETWEEN CLADDING TUBES

(71) Applicant: Consolidated Nuclear Security, LLC, Oak Ridge, TN (US)

(72) Inventors: Edward B. Ripley, Knoxville, TN (US); William A. Ripley, Knoxville, TN (US)

(73) Assignee: Consolidated Nuclear Security, LLC, Oak Ridge, TN (US)

( * ) Notice: Subject to any disclaimer, the term of this patent is extended or adjusted under 35 U.S.C. 154(b) by 316 days.

(21) Appl. No.: 17/060,213

(22) Filed: Oct. 1, 2020

(51) Int. Cl.

| | |
|---|---|
| ***H05H 6/00*** | (2006.01) |
| ***G21G 1/00*** | (2006.01) |
| *G21K 5/08* | (2006.01) |
| *G21G 1/02* | (2006.01) |

(52) U.S. Cl.
CPC ..... *H05H 6/00* (2013.01); *G21G 1/001* (2013.01); *G21G 1/0005* (2013.01); *G21G 1/02* (2013.01); *G21G 2001/0094* (2013.01); *G21K 5/08* (2013.01)

(58) Field of Classification Search
CPC ..... H05H 6/00; G21G 1/001; G21G 1/02; G21G 2001/0094; G21G 1/0005; G21K 5/08
USPC ..... 376/202
See application file for complete search history.

(56) References Cited

U.S. PATENT DOCUMENTS

| | | | | |
|---|---|---|---|---|
| 3,594,275 | A * | 7/1971 | Ransohoff | G21C 1/303 376/202 |
| 3,860,041 | A * | 1/1975 | Leiter | F16L 9/16 138/144 |
| 6,160,862 | A | 12/2000 | Wiencek et al. | |
| 10,109,383 | B1 | 10/2018 | Pärnaste | |
| 2011/0255646 | A1 | 10/2011 | Eriksson et al. | |
| 2014/0226773 | A1 | 8/2014 | Toth et al. | |
| 2018/0166179 | A1 | 6/2018 | Piefer | |

FOREIGN PATENT DOCUMENTS

| | | | |
|---|---|---|---|
| CN | 106851957 | A | 6/2017 |
| WO | 0115176 | A1 | 3/2001 |
| WO | 2018106681 | A1 | 6/2018 |

* cited by examiner

*Primary Examiner* — Jack W Keith
*Assistant Examiner* — Daniel Wasil
(74) *Attorney, Agent, or Firm* — Luedeka Neely, P.C.

(57) ABSTRACT

An annular radioisotope target and method therefor that includes an inner cladding tube and a helical coil-shaped foil ribbon disposed over the inner cladding tube. The helical coil-shaped foil ribbon has a first end, a second end, a first edge and a second edge. An outer cladding tube is disposed over the helical coil-shaped foil ribbon and inner cladding tube, and end caps are attached to the outer cladding tube and the inner cladding tube.

14 Claims, 3 Drawing Sheets

METHOD OF MAKING AN ANNULAR RADIOISOTOPE TARGET HAVING A HELICAL COIL-SHAPED FOIL RIBBON BETWEEN CLADDING TUBES

GOVERNMENT RIGHTS

The U.S. Government has rights to this invention pursuant to contract number DE-NA0001942 between the U.S. Department of Energy and Consolidated Nuclear Security, LLC.

TECHNICAL FIELD

The disclosure relates to radioisotope production, and more particularly to methods and apparatus for assembling annular radioisotope targets.

BACKGROUND

Among the problems of fabrication of annular composite radioisotope targets 10 (FIG. 1) is the assembly process. The flat foil 12 is typically sandwiched between inner cladding tube 14 and outer cladding tube 16, and the ends are welded to prevent migration of the irradiated target foil 12. The flat foil 12 is generally rolled into a "C" shape and wrapped around inner cladding tube 14 as shown in the cross-sectional view of the target 10 in FIG. 1. End caps 22 (FIG. 4, one shown) are positioned on each end of the inner cladding tube 14 to space the foil in the right position for irradiation, and the outer cladding tube 16 is slipped over the C-shaped foil 12 and inner cladding tube and is welded onto the end caps 22. The assembled C-shaped foil 12, inner cladding tube 14 and outer cladding tube 16 is usually stretched from the inside, (autofrettage, hydroforming or other method), or swaged from the outside to consolidate the assembly and bring the assembly into a predetermined final dimension. If the gap 18 between the edges of the foil is correct upon assembly, the process of swaging or stretching to consolidate and bring the assembly into the final predetermined dimension, will open up the edges of the C-shaped foil 12 as shown in FIG. 2, or in the case of compression push together and eventually overlap the edges 20 of the C-shaped foil 12 as shown in FIG. 3. The gap 18 and overlap 20 are not desirable when fabricating annular radioisotope targets 10.

Another problem associated with the conventional method of assembling radioisotope targets is that the C-shaped foil 12 must be compressed against the inner cladding tube 14 while disposing the outer cladding tube 16 over the foil 12 and inner cladding tube 14. During the assembly process, it is difficult to prevent the C-shaped foil 12 from buckling as the outer cladding tube 16 is slipped over the foil 12. Thus, much care and time are needed to assemble radioisotope targets using the conventional flat C-shaped foil 12.

SUMMARY

In view of the foregoing problems associated with conventional radioisotope targets and the assembly thereof, an embodiment of the disclosure provides an annular radioisotope target that includes an inner cladding tube and a helical coil-shaped foil ribbon disposed over the inner cladding tube. The helical coil-shaped foil ribbon has a first end, a second end, a first edge and a second edge. An outer cladding tube is disposed over the helical coil-shaped foil ribbon and inner cladding tube, and end caps are attached to the outer cladding tube and the inner cladding tube.

In another embodiment there is provided a method for making an annular radioisotope target. The method includes, providing an inner cladding tube and sliding a helical coil-shaped foil ribbon over the inner cladding tube. The helical coil-shaped foil ribbon has a first end, a second end, a first edge and a second edge. An outer cladding tube is disposed over the helical coil-shaped foil ribbon and inner cladding tube. End caps are attached to the outer cladding tube and inner cladding tube to seal the foil between the outer cladding tube and inner cladding tube.

In some embodiments, the cladding and end caps are made of an aluminum alloy. In other embodiments, the helical coil-shaped foil ribbon is made of a material selected from the group consisting of uranium, molybdenum, and an alloy thereof.

In some embodiments, the first edge and second edge of the helical coil-shaped foil ribbon are beveled. In other embodiments, the first edge of the helical coil-shaped foil ribbon and the second edge of the helical coil-shaped foil ribbon comprise tongue and groove edges.

In some embodiments, each of the inner cladding tube and outer cladding tube has a thickness ranging from about 1 to about 5 millimeters in thickness. In other embodiments, the foil has a thickness ranging from about 0.5 to about 2 millimeters. However, the cladding tubes and foil for the target are scalable, thus the foregoing ranges are used for illustration purposes and are adaptable to a particular size radioisotope target configuration.

In some embodiments, the helical coil-shaped foil ribbon has a diameter that is 5% to 20% less than an outside diameter of the inner cladding tube.

In some embodiments, the helical coil-shaped foil ribbon is devoid of gaps between the first edge of the helical coil-shaped foil ribbon and the second edge of the helical coil-shaped foil ribbon.

In some embodiments, the helical coil-shaped foil ribbon is compressed by the endcaps to eliminate gaps between the first edge and the second edge of the helical coil-shaped foil ribbon.

An advantage of making and using radioisotope targets made with a helical coil-shaped foil ribbon is that the target may be assembled much more easily and quickly with less interference between the helical coil-shaped foil ribbon and the outer cladding tube. The use of the helical coil-shaped foil ribbon is also effective to eliminate gaps between edges of the foil ribbon during the assembly and dimensioning process. Other features and advantages of the embodiments of the disclosure may be evident with reference to the attached drawings and following description.

DETAILED DESCRIPTION

Figure 4:
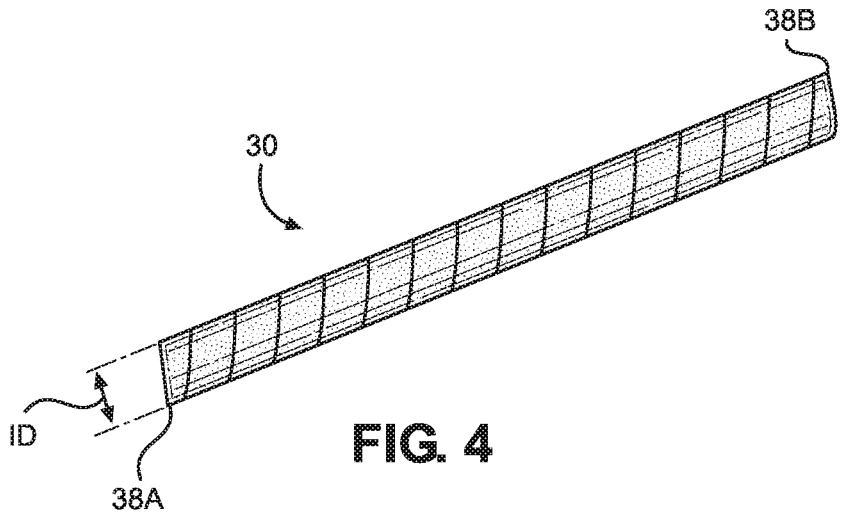
FIG. 4 is a perspective view, not to scale, of a helical coil-shaped foil ribbon for a radioisotope target according to the disclosure.
Figure 5:
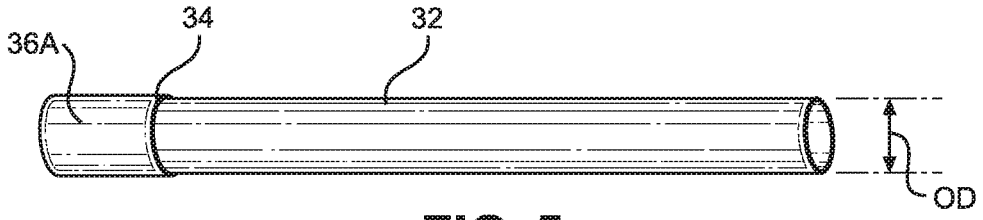
FIG. 5 is a perspective view, not to scale, of an inner cladding tube containing one end cap for a radioisotope target according to an embodiment of the disclosure.

An important feature of the disclosed embodiments is the use of a helical coil-shaped foil ribbon in the manufacture of radioisotope targets. With reference to FIGS. 4-10, the radioisotope target 28 (FIG. 10) includes a helical coil-shaped foil ribbon 30 having an inside coiled diameter (ID) that is slightly less than an outside diameter (OD) of the inner cladding tube 32 (FIGS. 4 and 5). For example, if the inner cladding tube has an OD of 2.54 cm, the ID of the helical-coil-shaped foil ribbon is 1.9 to 2.29 cm or 5 to 20% less than the OD of the inner cladding tube. The helical coil-shaped foil ribbon also has a springiness or resilience feature that enables the helical coil-shaped foil ribbon to be stretched to slide over an inner cladding tube and then to contract over the inner cladding tube for a close fit to the inner cladding tube when tension on the foil ribbon is released. Accordingly, edges of the helical-coil-shaped foil ribbon may be caused by the resilience feature to abut one another to avoid gaps in the foil ribbon 30 as described in more detail below.

It will be appreciated that the helical-coil shaped foil ribbon 30 can be made with a wide range of ribbon widths, lengths, thicknesses and IDs to accommodate different size target manufacturing capabilities. For example a 2.54 cm wide foil ribbon would be wound around an inner cladding tube of a selected diameter twice as many times as a 5.08 cm wide ribbon, and the 2.54 cm foil ribbon would be twice as long as the 5.08 cm foil ribbon. Thus, the length and width of the foil ribbon 30 are not particularly critical to provide the features and advantages of use of a foil ribbon 30 rather than a flat sheet foil that is bent into a "C-shaped" radioisotope target 28.

Figure 6:
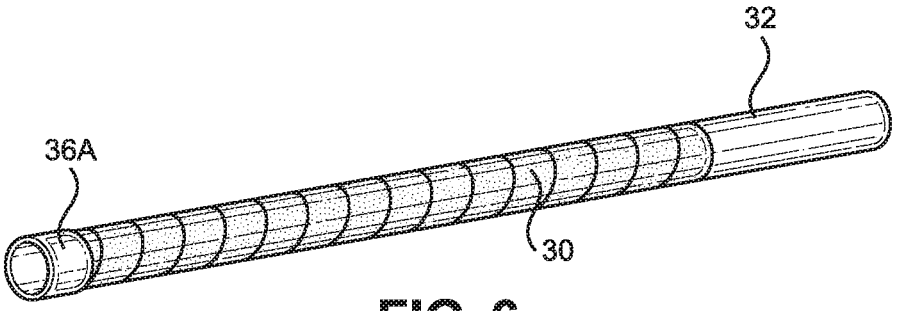
FIG. 6 is a perspective view, not to scale, of the helical coil-shaped foil ribbon of FIG. 5 disposed over the inner cladding tube of FIG. 4.
Figure 7:
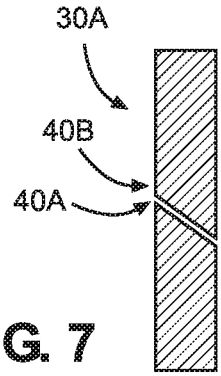
FIG. 7 is a cross-sectional view, not to scale, of the helical coil-shaped foil ribbon of FIG. 5 having adjacent beveled side edges.
Figure 8:
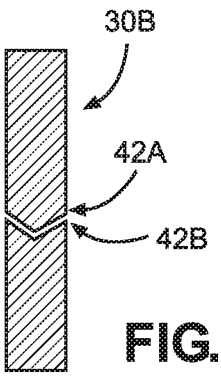
FIG. 8 is a cross-sectional view, not to scale, of the helical coil-shaped foil ribbon of FIG. 5 having adjacent tongue and groove side edges.
Figure 9:
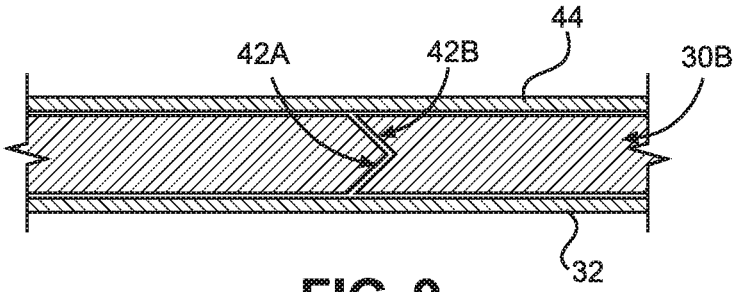
FIG. 9 is a cross-sectional view, not to scale, of a portion of a radioisotope target according to the disclosure containing the helical coil-shaped foil ribbon of FIG. 8.
Figure 10:
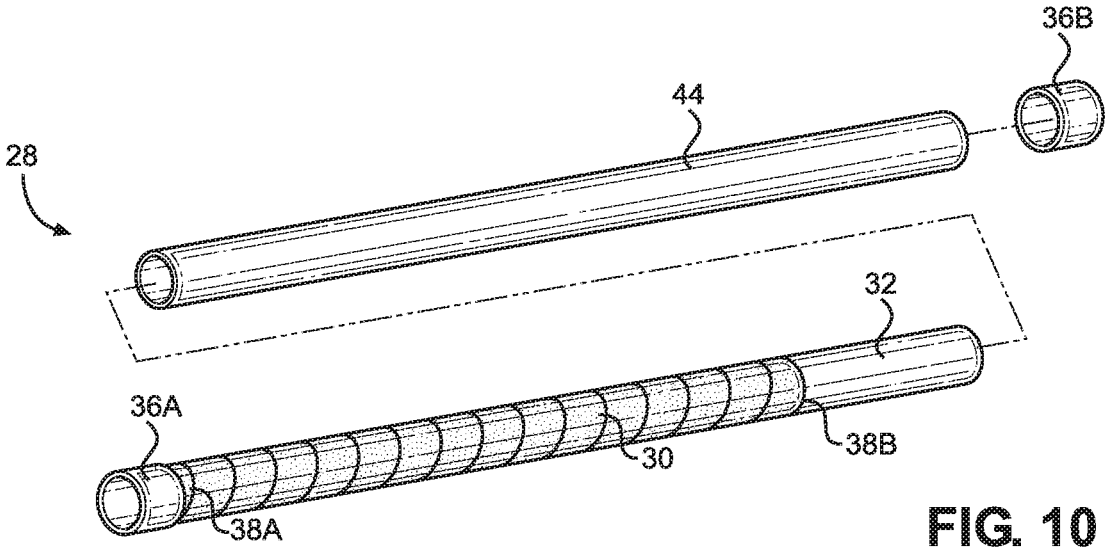
FIG. 10 is an exploded perspective view, not to scale, of a radioisotope target according to the disclosure.

In order to fit the foil ribbon 30 tightly against a raised edge 34 of end cap 36*a* and 36*b* (FIG. 10) of the radioisotope target 28 as shown in FIG. 6, first end 38*a* and second end 38*b* of the foil ribbon 30 are tapered with an angle that corresponds to the spiral angle of the helical coil. Likewise, in order to reduce gaps between successive turns of the helical coil-shaped foil ribbon 30, adjacent edges 40*a* and 40*b* may be beveled to provide foil 30*a* as shown in FIG. 7, or, as shown in FIG. 8, the edges 42*a* and 42*b* may be formed as tongue and groove edges to provide foil 30*b*. FIG. 9 illustrates a portion of the radioisotope target 28 containing foil 30*b* having tongue and groove edges 42*a* and 42*b* disposed between the inner cladding tube 32 and outer cladding tube 44. With the beveled edges (40*a* and 40*b*) or tongue and groove edges (42*a* and 42*b*), slight variations in manufacture of the edge finish may be tolerated without small imperfections in the edges manifesting themselves as gaps in the helical coil. The beveled or tongue and groove edges also reduce or eliminate the potential for radiation passing through a gap in the foil that could overexpose an opposite side of the helical coil-shaped foil ribbon 30.

After the foil ribbon 30 is disposed over the inner cladding tube 32, the outer cladding tube 44 may be slid over the foil ribbon 30 and inner cladding tube 32. Then a second end cap 36*b* having an outside diameter smaller than an inside diameter of the outer cladding tube 44 and the second end cap 36*b* having a larger inside diameter than the OD of the inner cladding tube 32 is slid onto the inner cladding tube 32 to contact the second end 38*b* of the foil ribbon 30 to compress the first end 38*a* of the foil ribbon 30 against end cap 36*a* and close up any gaps in the helical coil-shaped foil ribbon 30.

Figure 2:
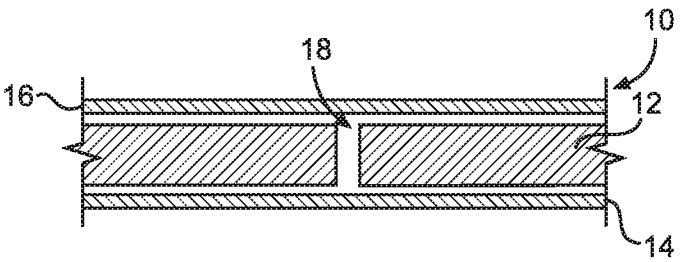
FIG. 2 PRIOR ART
FIG. 2 is a cross-sectional view, not to scale, of a portion of the conventional radioisotope target of FIG. 1 showing a gap between edges of the C-shaped foil.
Figure 3:
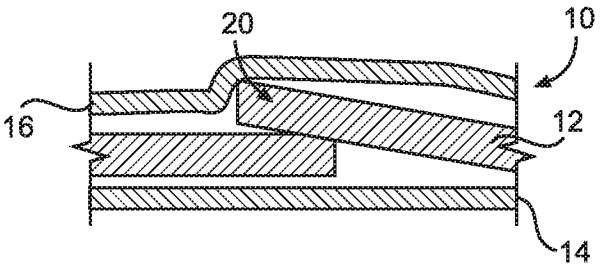
FIG. 3 PRIOR ART
FIG. 3 is a cross-sectional view, not to scale, of a portion of the conventional radioisotope target of FIG. 1 showing a foil edge overlap of the C-shaped foil.
Figure 1:
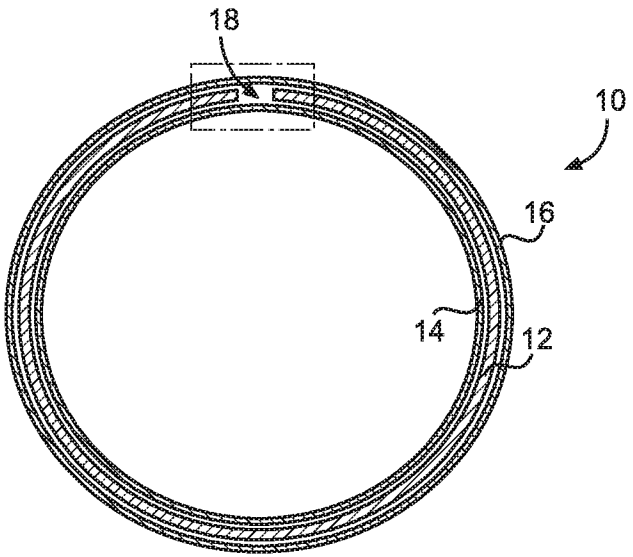
FIG. 1 PRIOR ART
FIG. 1 is a cross-sectional view, not to scale, of a conventional radioisotope target made with a C-shaped foil.

When the outer cladding tube 44 is disposed over the foil ribbon 30 and the second end cap 36*b* is put in place inside the outer cladding tube 44 and adjacent to second end 38*b* of the foil ribbon 30, pressure is applied to end caps 36*a* and 36*b* to cause gaps in the helical coil-shaped ribbon 30 to close. The end caps 36*a* and 36*b* are secured, optionally by welding, to the outer cladding tube 44 and then whether the target 28 assembly is stretched or swaged any remaining gaps simply get tighter/narrower, and do not open or cause overlap as in the case of the flat C-shaped foil 12 (FIGS. 2 and 3).

The use of a helical coil-shaped foil ribbon 30 in a radioisotope target 28 is novel and solves many of the manufacturing issues associated with using a flat C-shaped foil 12. Advantages of the helical coil-shaped foil ribbon 30 include, but are not limited to, ease of assembly and manufacture, ability to consolidate the spiral rings of the foil ribbon 30 by swaging or expansion without opening gaps or overlapping the edges of the foil ribbon 30. Accordingly, the helical coil-shaped foil ribbon 30 provides a more uniform target 28 for irradiation, and allows for ease of both assembly prior to exposure, and disassembly after exposure.

After the helical coil-shaped foil ribbon 30 is irradiated, the outer cladding 44 is removed from the structure by one of a number of methods. One method of removal is where the end caps 36*a* and 36*b* are cut off and the outer cladding tube 44 is scored deeply along the length of the outer cladding tube 44. Using the score line as a weak point, the outer cladding tube 44 may be peeled away from the helical coil-shaped foil ribbon 30 and removed. The peeling away of the outer cladding tube 44 has minimal impact on harvesting the foil ribbon 30 and subsequent isotope production steps. It decreases the total time to manufacture, and allows for higher production rates.

A wide variety of materials may be used as the radioisotope target 28 materials for the above-described embodiments. For example, nonfissionable metal materials selected from the group consisting of steel, stainless steel, nickel, nickel alloy, zirconium, zircaloy, aluminum, or zinc coated aluminum may be used for the end caps 36*a* and 36*b* and for the inner and outer cladding tubes 32 and 44, respectively. In one embodiment, the inner and outer cladding tubes 32 and 44 and the end caps 36*a* and 36*b* are made of aluminum or an aluminum alloy.

The overall dimensions of the radioisotope target 28 are limited only by the reactor design used to irradiate the foil ribbon 30. Accordingly, the cylinder-shaped tubes 44 may have lengths ranging from about 30 cm to about 60 cm. Outer diameters of the cylindrical cladding tubes 44 may range from about 2.0 cm to about 6.0 cm. Inner and outer cladding tube wall thicknesses may vary and may range from about 0.6 to 1.6 mm. Generally, the wall thicknesses are not critical, provided that radiation may easily penetrate the walls of the tubes to irradiate the target material and that proper heat conductance is achieved during the irradiation process. A typical irradiation process may include temperatures in the range of from about 500 to about 600° C.

The inner and outer cladding tubes 32 and 44 may be treated to improve the assembly and disassembly process. For example, the surfaces in contact with the foil ribbon 30 may be oxidized or nitrided to reduce bonding between the foil ribbon 30 and the inner and outer cladding tubes 32 and 44. In some embodiments, aluminum cladding tubes are used and are naturally oxidized by exposure to ambient atmosphere. In other embodiments, the inner and outer cladding tubes 32 and 44 are cleaned thoroughly to provide a smooth, clean surface for sliding over the foil ribbon 30.

The material of the helical coil-shaped foil ribbon 30 is not particularly critical to the disclosed embodiments provided it is a material that can be activated with neutrons. Accordingly, the foil ribbon 30 may be made of low enriched uranium metal, plutonium metal, or an alloy of uranium and molybdenum, such as 90 mol % uranium and 10 mol % molybdenum.

The thickness of the foil ribbon 30 may depend on the diameter of the inner and outer cladding tubes 32 and 44. In some embodiments, the foil ribbon may have a thickness ranging from about 0.02 mm to about 0.2 mm.

In some embodiments, a barrier material may be used to reduce or eliminate bonding between the foil ribbon 30 and the inner and outer cladding tubes 32 and 44. Radiation (recoil) enhanced diffusion can cause the foil ribbon 30 to bond with the inner and outer cladding tubes 32 and 44 making disassembly difficult. Recoil atom absorbing barriers may be used to prevent such recoil enhanced diffusion, and thus bonding. A number of metals have been found effective for use as recoil barriers, including, but not limited to, copper, nickel, iron and zinc. A primary target using one barrier may have the barrier disposed between the outer surface of the foil ribbon and the inner surface of the outer cladding tube, or between the foil ribbon and the outer surface of the inner cladding tube. In some embodiments, two barriers between the foil ribbon and the inner and outer cladding tubes, may be used. When one barrier is used, the barrier may be comprised of nickel metal. However, when two barriers are used, nickel, copper, iron or zinc may be used but it is preferred that the two barriers be selected from the same metal.

Barrier thickness, if used, may vary, depending upon the target configuration and the application. Such thickness may range from about 10 micrometers to 100 micrometers. However, since the recoil range for copper and nickel is approximately 7 micrometers, a copper or nickel barrier having a predetermined thickness of approximately 10 micrometers is desirably used. Additionally the manner in which the barrier is applied to the cladding tubes may vary. It is contemplated that the metal recoil barriers could exist as separate foils similar to that of the foil ribbon of fissionable material or applied to the foil ribbon of fissionable material by electrodeposition, ion implantation, electroplating, spraying or other similar methods.

After the radioisotope target 23 is irradiated, the outer cladding tube 44 is removed and the toil ribbon 30 is peeled from the inner cladding tube 32 and the irradiated foil ribbon 30 is dissolved in a chemical bath to extract isotopes.

A particular advantage of the disclosed embodiments is that the foil ribbon greatly reduces the time and complexity required to assemble the radioisotope targets. Accordingly, mass production of radioisotope targets is possible since gaps and overlaps of the foil are avoided by using the above described foil ribbon target. Also, the foil ribbon target avoids interference with the outer cladding tube 44 during the target assembly process since the foil ribbon can be made to tightly adhere to the inner cladding tube 30 by the resilience of the foil ribbon.

The foregoing descriptions of embodiments have been presented for purposes of illustration and exposition. They are not intended to be exhaustive or to limit the embodiments to the precise forms disclosed. Obvious modifications or variations are possible in light of the above teachings. The embodiments are chosen and described in an effort to provide the best illustrations of principles and practical applications, and to thereby enable one of ordinary skill in the art to utilize the various embodiments as described and with various modifications as are suited to the particular use contemplated. All such modifications and variations are within the scope of the appended claims when interpreted in accordance with the breadth to which they are fairly, legally, and equitably entitled.

What is claimed is:

1. A method for making an annular radioisotope target comprising, providing an inner cladding tube, sliding a helical coil-shaped foil ribbon over the inner cladding tube, the helical coil-shaped foil ribbon comprising a target material to be irradiated and having a first end, a second end, a first edge and a second edge, sliding an outer cladding tube over the helical coil-shaped foil ribbon and inner cladding tube, and attaching end caps to the outer cladding tube and inner cladding tube to seal the helical coil-shaped foil ribbon between the outer cladding tube and inner cladding tube.

2. The method of claim 1, wherein the first edge and second edge of the helical coil-shaped foil ribbon are beveled.

3. The method of claim 1, wherein the first edge of the helical coil-shaped foil ribbon and the second edge of the helical coil-shaped foil ribbon comprise tongue and groove edges.

4. The method of claim 1, wherein the helical coil-shaped foil ribbon is compressed by the endcaps to eliminate gaps between the first edge and the second edge of the helical coil-shaped foil ribbon.

5. The method of claim 1, wherein the step of sliding the helical coil-shaped foil ribbon over the inner cladding tube includes stretching the helical coil-shaped foil ribbon, sliding the stretched helical coil-shaped foil ribbon over the inner cladding tube, and contracting the helical coil-shaped foil ribbon over the inner cladding tube.

6. The method of claim 1, wherein the method includes placing a barrier material between the helical coil-shaped foil ribbon and at least one cladding tube.

7. The method of claim 1 wherein, prior to disposing the helical coil-shaped foil ribbon over the inner cladding tube, the helical coil-shaped foil ribbon has an inner diameter that is less than an outside diameter of the inner cladding tube.

8. The method of claim 7 wherein, the helical coil-shaped foil ribbon includes a resilience feature and the step of disposing the helical coil-shaped foil ribbon over the inner cladding tube includes:

stretching the helical coil-shaped foil ribbon to expand the inner diameter of the helical coil-shaped ribbon to be greater than the outside diameter of the inner cladding tube;

sliding the stretched helical coil-shaped foil ribbon over the inner cladding tube; and contracting the stretched helical coil-shaped foil ribbon over the inner cladding tube to provide a close fit between the helical coil-shaped foil ribbon and the inner cladding tube.

9. The method of claim 1 wherein the inner cladding tube includes an outside diameter;

the helical coil-shaped foil ribbon includes an inside diameter that is less than the outside diameter of the inner cladding tube in a non-stretched configuration, the helical coil-shaped foil ribbon operable to be stretched such that the inside diameter of the helical coil-shaped foil ribbon is greater than the outside diameter of the inner cladding tube in a stretched configuration; and the step of sliding the helical coil-shaped foil ribbon over the inner cladding tube includes applying tension to the helical coil-shaped foil ribbon to stretch the inside diameter of the helical coil from the non-stretched configuration to the stretched configuration to slide the helical coil-shaped foil ribbon over the inner cladding tube and releasing tension to the helical coil-shaped foil ribbon to compress the helical coil-shaped foil ribbon against the inner cladding tube.

10. The method of claim 9 wherein the helical coil-shaped foil ribbon is compressed inwards at the first end and the second end by the end caps to eliminate gaps between the first edge and the second edge of the helical coil-shaped foil ribbon.

11. The method of claim 9 wherein the first edge of the helical coil-shaped foil ribbon and the second edge of the helical coil-shaped foil ribbon are beveled to eliminate gaps between the first edge and the second edge of the helical coil-shaped foil ribbon.

12. The method of claim 9 wherein the first edge and the second edge of the helical coil shaped foil ribbon comprise tongue and groove edges to assist in eliminating gaps between the first edge and the second edge of the helical coil-shaped foil ribbon.

13. The method of claim 9 further comprising placing a barrier material between the helical coil-shaped foil ribbon and at least one of the inner cladding tube and the outer cladding tube.

14. The method of claim 9, wherein the inner diameter of the helical coil-shaped foil ribbon is 5% to 20% less than the outside diameter of the inner cladding tube in the non-stretched configuration.

* * * * *